United States Patent [19]

Wilson

[11] 4,287,687

[45] Sep. 8, 1981

[54] VARIABLE WORK HOLDING DEVICE FOR GRINDING GEMSTONES

[76] Inventor: Hugh R. Wilson, 10840 SW. 120th St., Miami, Fla. 33176

[21] Appl. No.: 53,903

[22] Filed: Jul. 2, 1979

Related U.S. Application Data

[63] Continuation of Ser. No. 900,158, Apr. 26, 1978, abandoned.

[51] Int. Cl.[3] ..... B24B 7/22; B24B 9/16

[52] U.S. Cl. ..... 51/229; 51/119; 51/122; 51/123 R; 51/131.1; 51/231; 51/232; 51/237 R; 51/237 M

[58] Field of Search ..... 51/122, 123 R, 125, 51/125.5, 124 R, 124 L, 229, 121, 119, 131.1, 231, 232, 237 R, 237 M; 125/30 R

[56] References Cited

U.S. PATENT DOCUMENTS

| | | | |
|---|---|---|---|
| 677,613 | 7/1901 | Armeny | 51/229 |
| 902,598 | 11/1908 | Ohanian | 51/124 R |
| 2,391,979 | 1/1946 | Kershaw | 51/122 |
| 2,527,592 | 10/1950 | Spira | 51/122 |
| 3,110,136 | 11/1963 | Spira | 51/229 |
| 3,624,968 | 12/1971 | Leibowitz | 51/122 |
| 4,084,352 | 4/1978 | Wheeler | 51/229 |

FOREIGN PATENT DOCUMENTS

| | | | |
|---|---|---|---|
| 120888 | 1/1946 | Australia | 51/229 |
| 404231 | 10/1924 | Fed. Rep. of Germany | 51/124 |
| 594390 | 6/1925 | France | 51/121 |
| 156407 | 8/1962 | U.S.S.R. | 51/124 |

OTHER PUBLICATIONS

IBM Technical Disclosure, vol. 14, No. 3, Aug. 1971.

*Primary Examiner*—Harold D. Whitehead
*Assistant Examiner*—K. Bradford Adolphson

[57] ABSTRACT

This invention is that of a variable work holding device to be used for the grinding of various gemstones and industrial diamonds. The design and structure of the device provides that the device may be set up to operate in five different modes and provides that the gemstone may be rotated while in contact with a grinding surface or moved over the face of a grinding surface in a reciprocating motion, or a combination of both rotation and reciprocation which exposes the grain of the stone to the grinding surface from all angles automatically searching out the grain of the stone for optimum cutting efficiency and by continuously moving the stone across the face of the grinding surface, wear is evenly distributed on the grinding surface and grooving of the grinding surface is avoided. The structure comprises a rotatable head for holding the work object. The head is mounted on a slide. A timing belt pulley is mounted on the head and a second timing belt pulley is mounted on a motor shaft so that when a timing belt is connecting the two pulleys, motive power is provided to rotate the head. An off-center mounting hole is provided in the motor pulley to form an eccentric action for reciprocation of the head on the slide and linkage is provided to maintain a constant distance between the motor pulley and the head pulley. By removing the timing belt and moving the linkage to a different position, a semi-circular movement may be imparted to the work object.

6 Claims, 11 Drawing Figures

VARIABLE WORK HOLDING DEVICE FOR GRINDING GEMSTONES

This is a continuation of application Ser. No. 900,158 filed Apr. 26, 1978, now abandoned.

FIELD OF THE INVENTION

The device is intended for use in the grinding of gemstones and for grinding industrial diamonds for industrial tools.

DESCRIPTION OF THE PRIOR ART

This invention is intended for use with an ordinary skeif and although the skeif is a device that has been used for many years, the simple dop holding means usually employed is very crude and presents many problems. One great problem is that the worker must first establish the best cutting position of the diamond. Since the grain of the diamond is not readily apparent, it must be found by trial and error. This device eliminates this trial and error procedure and saves many manhours as the device, by continuously rotating the diamond, will search for the grain automatically. Another serious problem encountered with the traditional dop holder is that it remains stationary on the skeif and after some use develops a groove in the face of the skeif where it is in contact with the stone being ground. This necessitates a re-surfacing of the skeif and such re-surfacing is expensive. This invention, by continously moving the dop over the face of the skeif avoids the usual grooving as the wear is evenly distributed across the face of the skeif. This results in a great savings in time, cost, and of the diamond dust used in charging the face of the skeif. The structure and function of this new invention is both new and novel and constitutes a novel improvement.

SUMMARY OF THE INVENTION

It is an object of this invention to provide a new and novel work holding device that is efficient, cheap to manufacture and that will increase production in the field of gem and industrial diamond grinding.

It is another object of this invention to provide the novel rotation of the diamond to search the grain of the diamond for maximum cutting efficiency.

It is also an object of this invention to provide the continuous movement of the stone across the face of the grinding surface to avoid grooving of the face of the grinding surface.

It is a further object of this invention to provide the variation in the manner in which the invention may be used to more closely adapt it to the needs of the user.

It is also an object of this invention to provide a new and novel device whereby the productivity and profits of the user may be increased.

A BRIEF DESCRIPTION OF THE DRAWINGS

DESCRIPTION OF THE PREFERRED EMBODIMENT

Figure 1:
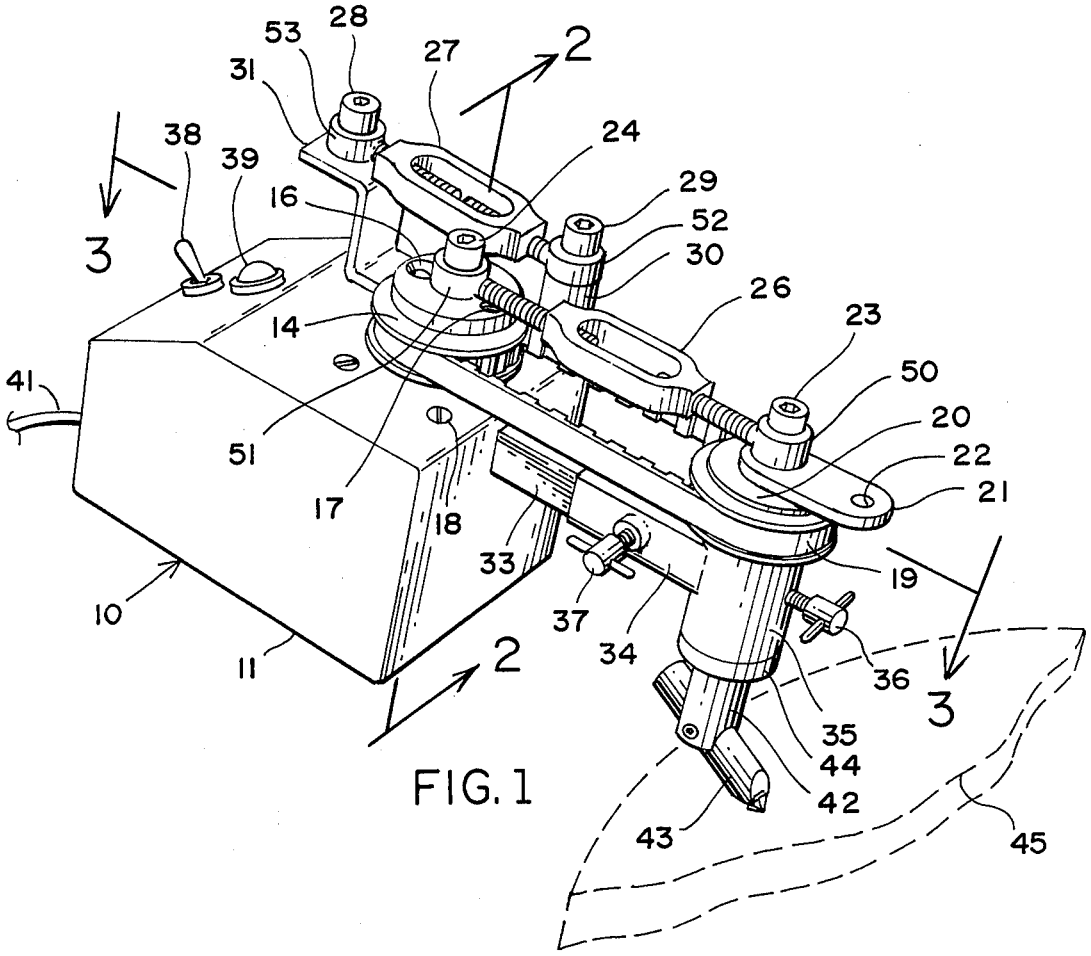
FIG. 1 shows the device in a working position with the gemstone in contact with a skeif.
Figure 4:
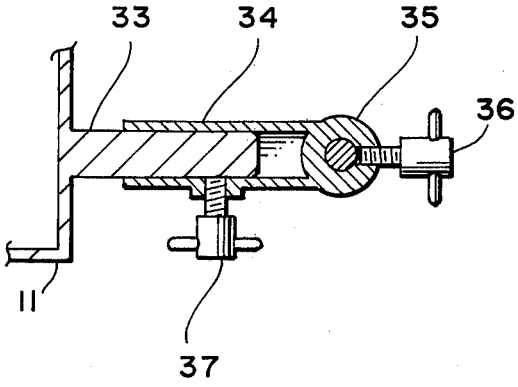
FIG. 4 is a sectional view of the head and slide and showing the locking thumbscrews.

Referring to the drawings by characters of reference, FIGS. 1–11 illustrate a variable work holding device for grinding gemstones 10.

Figure 8:
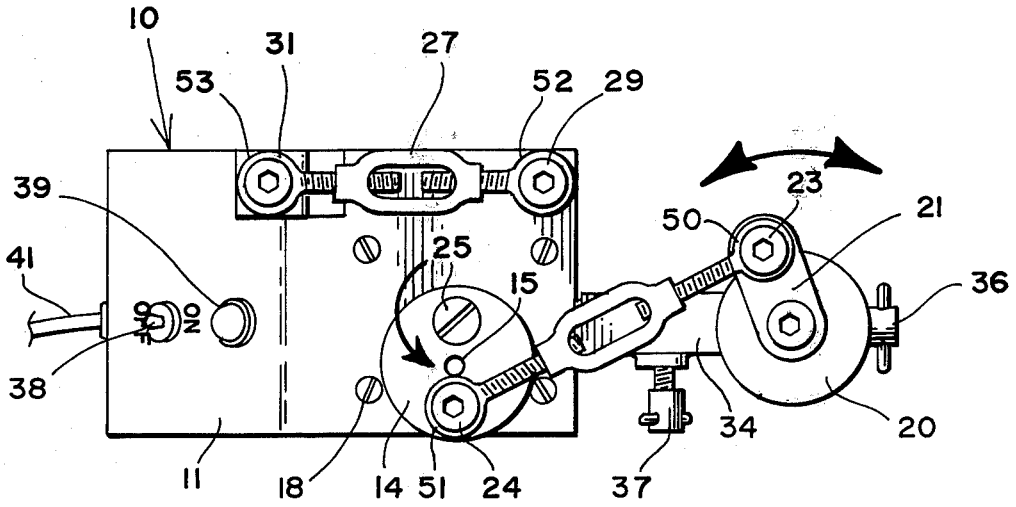
FIG. 8 shows a top view of the device with the timing belt removed, the motor pulley in an off-set position on the motor shaft, the linkage ends in an off-set position on the motor pulley and the head pulley, the slide locked by the slide thumbscrew, to give a partial rotation to the head spindle.

The body 11 is fitted with a slide bar 33 and a gearreduced motor unit 12. A slide sleeve 34 is mounted on the slide bar 33 to allow reciprocal movement of the spindle head 35 which is mounted on the slide sleeve 34. The axis of the spindle shaft 42 must be perpendicular to the plane of the abrading surface of the skeif with which the device will be used. A timing belt pulley 14 is mounted on the driving shaft 13 of the motor 12 and is retained in place by the screw 24. A second timing belt pulley 20 is mounted on the top end of the spindle shaft 42 which extends vertically through the spindle head 35 and the timing belt pulley 20 is held in place by the screw 23. The timing belt 19 connects the two pulleys 14 and 20 to provide rotation to the spindle shaft 42 when complete rotation of the spindle shaft 42 is desired. The adjustable link 26 is provided to adjust the tension of the timing belt 19 and also to act as a connecting rod to transmit an arcuate motion to the spindle shaft 42 and the dop 43 when the device is set up in several of the various modes. The linkage end 50 is held in place on the pulley 20 by the screw 23 and the other end 51 is held in place on the pulley 14 by the screw 24. The pulley 14 is provided with the three holes 15,16 and 17. The center hole 15 is provided for concentric rotation of the pulley 14 for mounting on the motor shaft 13 when reciprocation is not wanted. The motor shaft 13 is mounted in the off-set hole 16 when reciprocation of the slide sleeve 34 is desired or when an arcuate motion or semi rotation of the spindle shaft 42 is desired. The hole 17 is an alternate position for the linkage end 51 and the screw 24 and is used when additional eccentricity is required for a semi-rotational movement as shown in FIG. 8.

Figure 7:
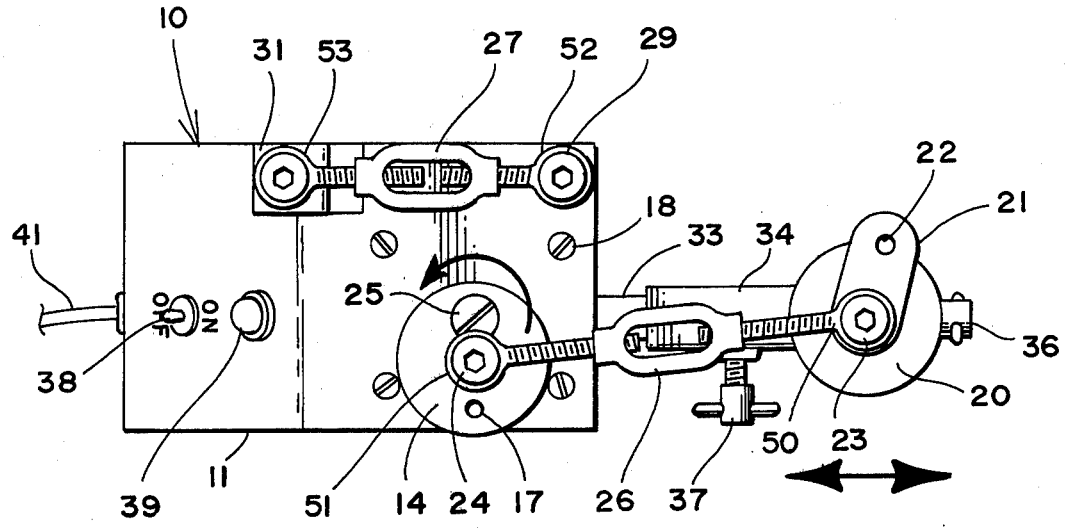
FIG. 7 shows a top view of the device with the timing belt removed, the motor shaft in an off-set position in the motor pulley, the head spindle locked by the head spindle thumbscrew and providing a reciprocal motion to the head but not a rotational movement.

In the mode of operation as shown in FIG. 7, constant rotation or semi-rotation of the spindle shaft 42 is not desirable and the lock screw 36 is provided to hold the spindle shaft 42 in a fixed position. In the mode of operation shown in FIG. 8, the spindle shaft 42 is moved in a semi-rotation but there is no reciprocal movement of the spindle head 35 and it is necessary to lock the slidesleeve 34 by use of the lock screw 37 which is provided for this purpose. The arm 21 on the pulley 20 is provided to connect with the linkage 26 and is connected to the linkage end 50 by the screw 23 in the hole 22 of the arm 21. In this mode the other linkage end 51 is mounted in the hole 17 by the screw 24. The pulley 14 is mounted on the motor shaft 13 by the screw 25 in the hole 16. In the mode of operation shown in FIG. 10, the linkage 27 is employed. In the other modes of operation, the linkage 27 remains parked with the end 52 secured to the post 30 by the screw 29 and the linkage end 53 secured to the bracket 31 by the screw 28.

Figure 10:
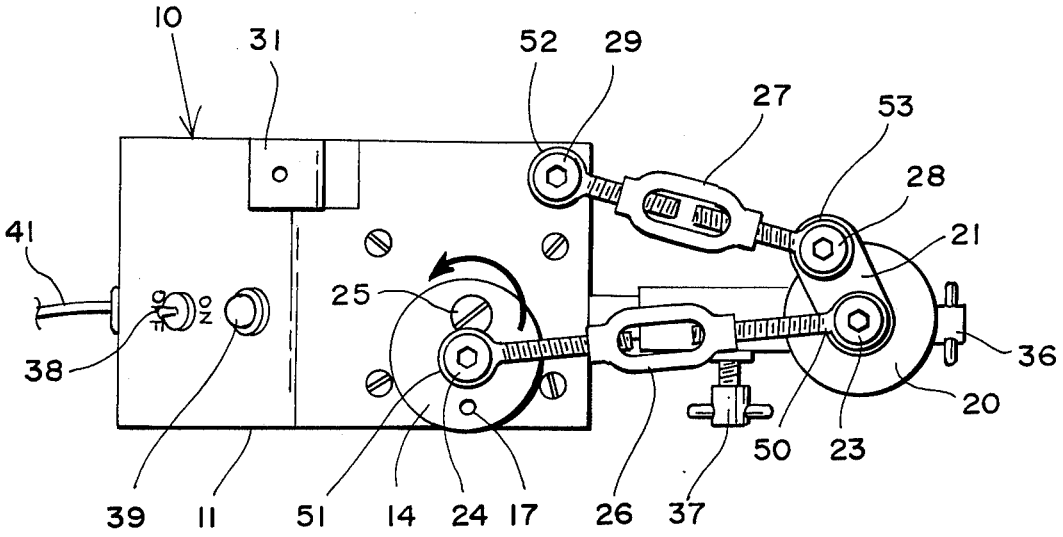
FIG. 10 shows a top view of the device with the timing belt removed, the long linkage in a center position in the motor pulley and the head pulley, the motor shaft in an off-set position in the motor pulley and the short linkage connected to the arm on the head pulley, to provide a reciprocal motion to the slide and a rotation to the head spindle.

To use the device in the mode shown in FIG. 10, the linkage end 53 is removed from the bracket by removing the screw 28. The end 53 is then attached to the arm 21 of the pulley 20 and held in place by the screw 28 in the hole 22 of the arm 21. This mode of operation is intended for fine finishing operations.

Figure 9:
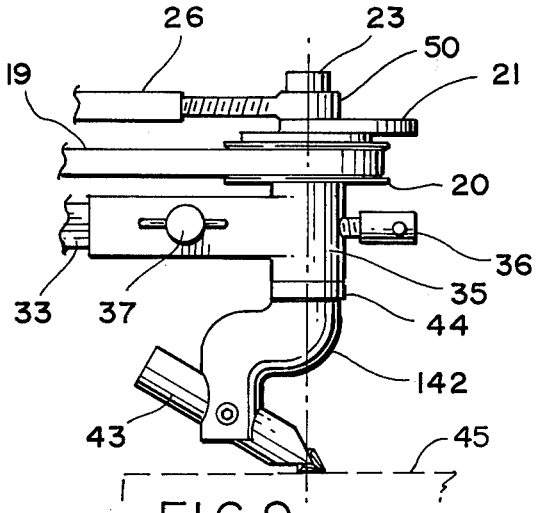
FIG. 9 shows a side view of the head with an off-set dop holder to align the diamond with the center line or axis of the head spindle and also shows that the spindle is to be perpendicular to the abrading surface.
Figure 2:
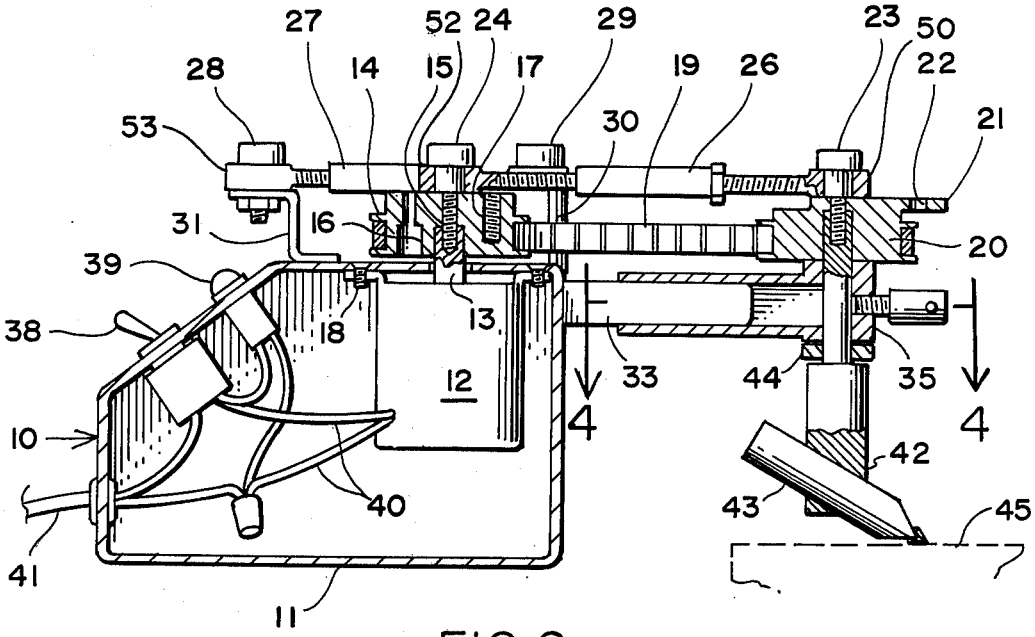
FIG. 2 shows a side sectional view of the device shown in FIG. 1.
Figure 3:
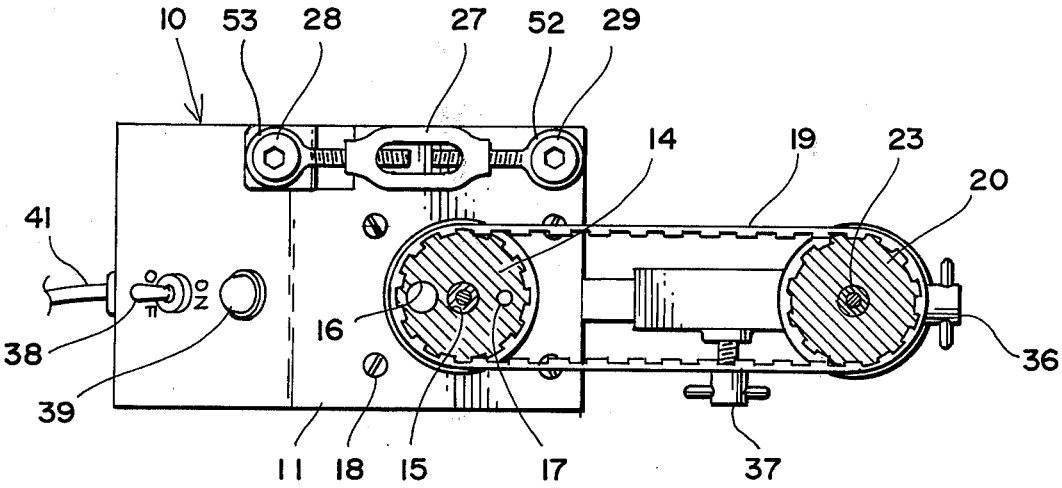
FIG. 3 is a top view showing the timing belt pulleys in cross section.

The off-set dop holding shown on spindle shaft 142 in FIG. 9, is intended for use when the device is used on a very small skeif 45 and allows a very limited reciprocal movement while providing full rotational movement.

The gear reduced motor 12 is mounted in the body 11 by the mounting screws 18 and is provided with the switch 38 and the indicator light 39 and is connected to the motor 12 by wires 40 connected with electric cord 41. The spindle shaft 42 is provided with the thrust bearing 44 to absorb wear caused by upward thrust when the device is in operation.

OPERATION OF THE DEVICE

This new and novel device provides the small shop owner with a very useful and unique tool that can be used to perform many operations in a diamond grinding shop when grinding gems and industrial dressing tools and because of the unique design it can be used for many special needs that might arise in grinding operations. In a first mode, the device is used with the timing belt installed on the pulleys 14 and 20 and with the linkage end 51 mounted on center hole 15 of pulley 14 the linkage end 50 mounted on center hole 23 of the pulley 20 and the motor shaft 13 mounted in hole 15 of the pulley 14.

This produces a purely rotational movement to the spindle shaft 42 and to the dop 43. The rotational movement so imparted moves the stone holding dop 43 in a circular path on the face of the skeif which exposes the surface of the stone to the grinding or polishing action of the skeif from all angles and exposes the grain of the stone to the most favorable positions for efficient cutting. At the same time the contact of the stone with the surface of the skeif is distributed across a wide area and gives an even wearing of the face of the skeif surface as well as exposing the stone to a continuously fresh grinding surface. This eliminates the usual grooves that appear on the face of a skeif as is usual with a stationary dop.

Figure 5:
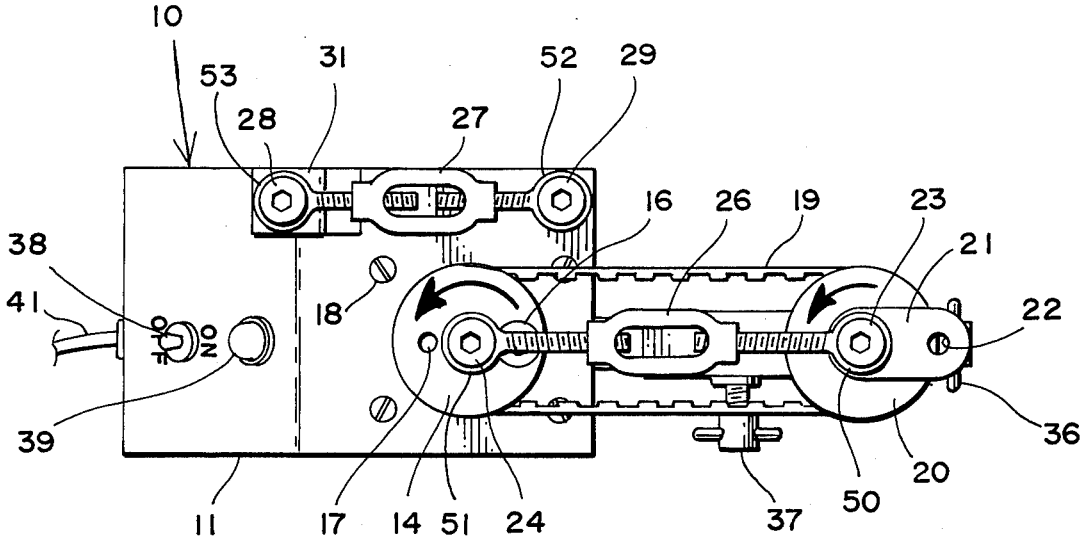
FIG. 5 shows a top view of the device with the timing belt installed and the motor pulley in a concentric position on the motor shaft to provide only rotary motion to the head.

The first mode is illustrated in FIG. 1 and in FIG. 5 which shows the positions of the pulleys and linkage.

Figure 6:
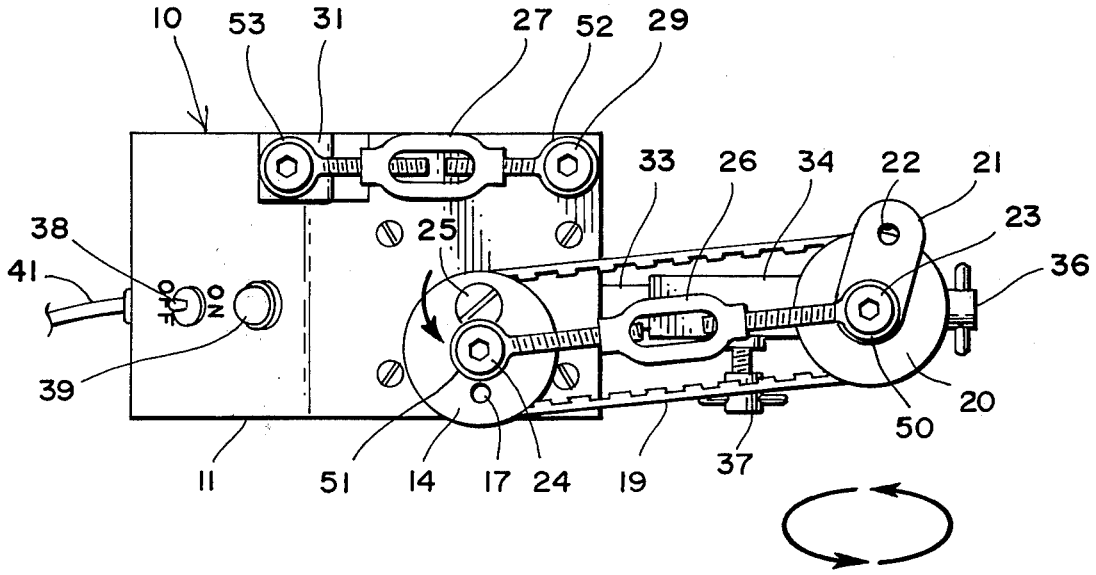
FIG. 6 shows a top view of the device with the timing belt installed and the motor shaft in an off-set position in the motor pulley to provide a reciprocal motion as well as a rotary motion to the head.

A second mode of operation is shown in FIG. 6 where the linkage end 51 is mounted in center hole 15 of pulley 14 but the motor shaft 13 is now moved to hole 16 of pulley 14 and the linkage end 50 remains in the center of the pulley 20. This mode now produces a reciprocal movement of the spindle head 35 and the slide sleeve 34 and causes the dop 43 to describe an oval path across the face of the skeif surface and thereby covers a greater area which increases the cutting speed of the skeif in relation to the stone.

FIG. 7 illustrates a third mode of operation of the device in which the timing belt 19 has been removed from the pulleys 14 and 20, the positions of the linkage ends 50 and 51 remain as in the second mode of operation as well as the position of the motor shaft 13. This mode produces a reciprocal motion of the spindle head 35 and the slide sleeve 34 but the lock screw 36 is tightened to prevent turning of the spindle shaft 42 and the dop 43 is moved across the face of the skeif in a straight line without rotation. The user may loosen the lock screw 36 at any time and manually rotate the dop 43 to a different position if he so desires so as to expose the grain of the stone to the most favorable cutting position.

A fourth mode of operation is shown in FIG. 8 in which the timing belt 19 is not used and the linkage end 51 is now moved to the hole 17 of the pulley 14, the motor shaft 13 remaining in the hole 16 of the pulley 14 and the linkage end 50 is moved to the hole 22 of the arm 21 of the pulley 20 and is secured by the screw 23. The lock screw 36 of the spindle head 35 is loosened to permit rotation of the spindle shaft 42. The lock screw 37 of the slide sleeve 34 is tightened to prevent movement of the spindle head 35 and a semi-rotation is given to the spindle shaft 42 causing an arcuate movement of the dop 43 across the face of the skeif. This mode as in the first and second modes will search for the grain of the stone and will distribute the wear across the face of the skeif but in a more limited manner and may be used when space is limited or if the timing belt should be misplaced or broken.

Figure 11:
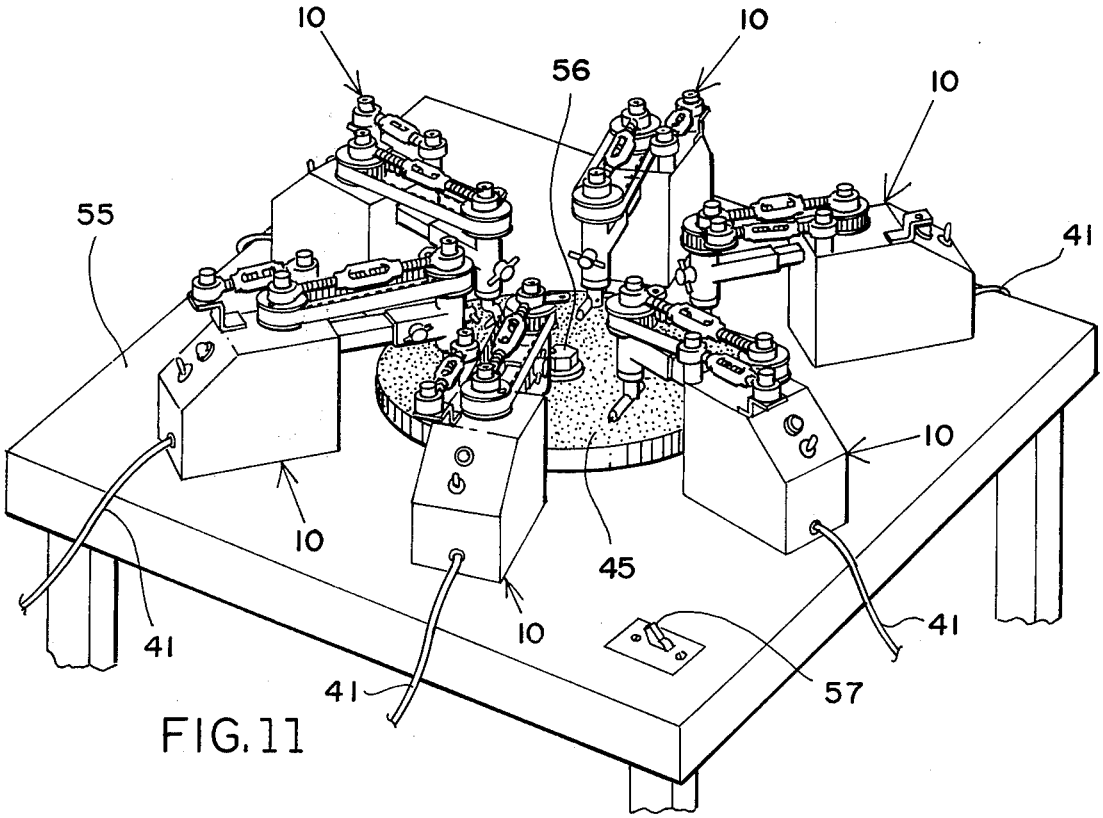
FIG. 11 shows a skeif with multiple units of the device in use at the same time.

A fifth mode of operation is illustrated in FIG. 10. In this mode the linkage 27 is brought into use. This mode is intended for fine finish operations in which an extra fine granulation of diamond dust is used. This mode allows the user to charge only a very narrow area of the skeif with the extra fine dust and limits the movement of the stone to a very small area but provides a semi rotational movement to search the grain of the stone and without removing the dop for re-positioning. This assures no loss of alignment of the facet of a stone that had been ground using one of the faster cutting modes of operation as it is not necessary to disturb the position of the dop if it was properly set at the beginning of the grinding process. To properly set the dop for this mode it is desirable to position the dop so that the stone is directly under the hole 22 of the arm 21 of pulley 20. After grinding a stone using one of the modes previously described, a fine finish surface is obtained by (see FIG. 10) securing the linkage end 51 in the hole 15 of pulley 14, mount the motor shaft 13 in the hole 16 of pulley 14. The linkage end 50 is held in the center of the pulley 20 by the screw 23. The linkage 27 is now disengaged from the bracket 31 by removing the screw 28 and the linkage end 53 of the linkage 27 is attached to the arm 21 of the pulley 20 by the screw 28 in the hole 22 of the arm 21. The two lock screws 36 and 37 are loose so that the slide sleeve 34 is free to reciprocate and the spindle shaft 42 is free to rotate in the spindle head. The reciprocation of the spindle head 35 causes the pulley 20 to rotate in a arcuate manner and the dop swings about an axis that centers below the centerline of the hole 22 in the arm 21 which maintains the stone in a relative stationary position but rotates the stone sufficiently to maintain a cutting exposure to the most favorable grain of the stone. By restricting the working area of the skeif in this manner a more limited amount of diamond is required and a great savings is realized by the user of the device. As shown in FIG. 11 at least six units of the device may be used at the same time. The term "dop" has been used herein to describe the work object being ground. It is to be understood however, that a "dop" is meant to include diamonds that are held in industrial dressing tools and the like.

Although but a few embodiments of the invention have been shown and described, it will be apparent to those skilled in the art that various changes and modifications may be made therein without departing from the spirit of the invention or from the scope of the appended claims.

What is claimed is:

1. In an abrading device with a planar abrading surface, a work holding device for grinding gemstones and industrial diamond tools comprising:

(a) a body;

(b) an extension means fixedly mounted on said body and extending from said body on a plane parallel to the plane of said abrading surface;

(c) a rotatable dop holding means adapted for holding a stone bearing dop means, said rotatable dop holding means being moveably mounted on said fixed extension means;

(d) a first and second pulley means, said first pulley means mounted on said body for eccentric movement and said second pulley means mounted on said rotatable dop holding means;

(e) a timing belt adapted to be connected between said first and second pulley means;

(f) a linkage means, said linkage means adapted to be connected between said first and second pulley means; and (g) said second pulley means including means providing powered movement for said rotatable dop holding means.

2. Apparatus as set forth in claim 1 wherein a stone bearing dop means may be extended beyond the axis of said rotatable dop holding means causing said stone bearing dop means to move across the face of an abrading surface in an arcuate path for grinding of said stone.

3. A work holding device for use with a planar abrading surface for grinding gemstones and industrial diamond tools comprising:

(a) a body;

(b) an extension means fixedly mounted on said body on a plane parallel to the plane of said abrading surface;

(c) a rotatable dop holding means adapted for holding a stone bearing dop means, said rotatable dop holding means being moveably mounted on said fixed extension means;

(d) motive power means for providing powered movement for said rotatable dop holding means;

(e) means for transmitting said powered movement from said motive power means to said rotatable dop holding means for movement of said stone bearing dop means; and (f) said means for transmitting including a first linkage means connecting said motive power means to said rotatable dop holding means to provide reciprocal movement to said rotatable dop holding means and a second linkage means with one end of said second linkage means connected to said rotatable dop holding means and positioned eccentric to the axis of rotation of said rotatable dop holding means, the other end of said second linkage means connected to an abutment adjacent to said fixed extension means, said second linkage means imparting a semi-rotational movement to said rotatable dop holding means during the reciprocation caused by said first linkage means.

4. Apparatus as set forth in claim 3 wherein said stone bearing dop means may be extended beyond the axis of said rotatable dop holding means moving said stone bearing dop means in a circular path across the face of an abrading surface for grinding of said stone.

5. A work holding device for grinding gemstones and industrial diamonds comprising:

a work holding means for holding a stone in contact with the cutting surface of a grinding skeif said work holding means comprising:

slide bar means mounted on said work holding means for receiving a slideable spindle head, a slideable spindle head mounted on said slide bar for holding a rotatable spindle, spindle means mounted in said spindle head for rotating a dop, dop holding means mounted on said spindle means for holding a stone bearing dop, motive power means for powered operation of the device and for rotation of said spindle means, pulley means mounted on said spindle means for imparting rotary motion to said spindle means, eccentric pulley means mounted on said motive power means for use with a belt, belt means connecting said eccentric pulley means with said pulley means mounted on said spindle means for transmitting motion from said motive power means to said spindle means, linkage means, a first end of said linkage means mounted on said eccentric pulley means and a second end mounted on said spindle means for providing reciprocation to said spindle head and for maintaining a constant tension to said belt means, whereby when said motive power means rotates said eccentric pulley means said linkage means reciprocates said spindle head on said slide bar and said belt means rotates said pulley means mounted on said spindle means thereby rotating said dop holding means and a stone bearing dop and causing a stone to move across the the cutting surface of a grinding skeif in a reciprocating motion combined with a constant rotary motion for grinding said stone.

6. The structure as recited by claim 5 wherein said dop holding means is adjustable and said dop may be extended beyond the axis of said spindle means causing said stone to move in an oval path across the face of the cutting surface of a grinding skeif.

* * * * *